US005658420A

United States Patent [19]

Rossini

[11] Patent Number: 5,658,420

[45] Date of Patent: Aug. 19, 1997

[54] APPARATUS FOR APPLYING ADHESIVE TAPE

[75] Inventor: Steven J. Rossini, St. Paul, Minn.

[73] Assignee: Minnesota Mining and Manufacturing Company, Saint Paul, Minn.

[21] Appl. No.: 712,243

[22] Filed: Sep. 12, 1996

Related U.S. Application Data

[63] Continuation of Ser. No. 277,978, Jul. 20, 1994, abandoned.

[51] Int. Cl.[6] ..... B32B 31/00

[52] U.S. Cl. ..... 156/504; 156/505; 156/577; 156/353; 156/522

[58] Field of Search ..... 156/521, 522, 156/523, 505, 506, 517, 519, 353, 361, 540, 541, 574, 577, 504

[56] References Cited

U.S. PATENT DOCUMENTS

| | | | |
|---|---|---|---|
| 3,066,723 | 12/1962 | Remington et al. | 156/522 |
| 3,406,084 | 10/1968 | Varga | 156/522 |
| 3,630,346 | 12/1971 | Burnside | 206/56 |
| 3,765,992 | 10/1973 | Stageberg | 156/521 |
| 4,094,715 | 6/1978 | Henderson et al. | 156/195 X |
| 4,094,727 | 6/1978 | Collins . | |
| 4,177,959 | 12/1979 | Lancaster et al. | 242/58.2 |
| 4,398,379 | 8/1983 | Burford | 53/77 |
| 4,459,170 | 7/1984 | Kerwin | 156/361 |
| 4,473,429 | 9/1984 | Crankshaw | 156/483 |
| 4,555,288 | 11/1985 | Nozaka | 156/191 |
| 4,597,820 | 7/1986 | Nozaka | 156/353 |
| 4,636,276 | 1/1987 | Nozaka | 156/540 X |
| 4,666,550 | 5/1987 | Spiers et al. | 156/361 |
| 4,685,392 | 8/1987 | Watanabe . | |
| 4,708,761 | 11/1987 | Taniguchi et al. | 156/576 X |
| 4,784,714 | 11/1988 | Shibata | 156/DIG. 31 X |
| 4,861,411 | 8/1989 | Tezaka | 156/344 |
| 4,892,610 | 1/1990 | Sano . | |
| 4,905,924 | 3/1990 | Moore | 242/58.5 |
| 4,980,011 | 12/1990 | Gruber et al. | 156/361 |
| 5,076,878 | 12/1991 | McLees et al. | 156/353 |
| 5,188,696 | 2/1993 | Good, Jr. | 156/540 X |
| 5,212,002 | 5/1993 | Madrzak et al. | 428/40 |
| 5,431,767 | 7/1995 | Koza et al. | 156/350 |

FOREIGN PATENT DOCUMENTS

| | | |
|---|---|---|
| 2025473 | 8/1991 | Canada . |
| 2069247 | 8/1992 | Canada . |
| 0 418 527 A2 | 8/1990 | European Pat. Off. . |
| 330-567 | 10/1973 | Germany . |
| 2 331 125 | 8/1974 | Germany . |
| 2 318 353 | 10/1974 | Germany . |
| 23 37 663 | 2/1975 | Germany . |
| 31 12775 A1 | 10/1982 | Germany . |
| 3402 582 A1 | 8/1985 | Germany . |
| 3614264 A1 | 10/1987 | Germany . |
| 0 512 196 A1 | 11/1992 | Germany . |
| 0 640 545 A1 | 3/1995 | Germany . |
| 59-118649 | 9/1984 | Japan . |
| 60-128155 | 9/1985 | Japan . |
| 2 025 376 | 1/1980 | United Kingdom . |
| WO93/07063 | 4/1993 | WIPO . |

*Primary Examiner*—James Engel
*Attorney, Agent, or Firm*—Gary L. Griswold; Walter N. Kirn; Matthew B. McNutt

[57] ABSTRACT

An apparatus for applying a length of adhesive tape from a supply of adhesive tape along the length of the leading edge of a roll of web material includes a cutting mechanism for cutting the length of web material to form a leading edge on the roll of web material. An application mechanism of the apparatus is configured to remove adhesive tape from the supply of adhesive tape and apply adhesive tape along the leading edge of the web material. A take-up mechanism removes a liner from the adhesive tape prior to the application of the adhesive tape to the leading edge. A tape cut off mechanism cuts the adhesive tape to form the length of adhesive tape along the leading edge of the web material. A buffing mechanism contacts the adhesive tape uniformly and simultaneously along the length of the leading edge to ensure contact between the adhesive tape and an outer layer portion of the roll of web material that is directly adjacent the leading edge.

26 Claims, 9 Drawing Sheets

88
10
32
82
52
89
81
56
36
110
112
107
114
12
90
108
18
106
104
14
83
A
92
84
91
96
142
42
166
94
120
34
98
28
38
22
100
140
44
16
46
43

96
94
92
120
102
184
56
182
98
100
180
52

96
94
92
120
184
102
56
182
98
186
100
180
52

APPARATUS FOR APPLYING ADHESIVE TAPE

This is a continuation of application Ser. No. 08/277,978 filed Jul. 20, 1994 now abandoned.

BACKGROUND OF THE INVENTION

The present invention relates generally to an apparatus and method for applying a strip of material to a surface. In particular, the present invention is an apparatus for applying flying splice, pressure sensitive, adhesive tape to a leading edge of a roll of web material.

In the newspaper and magazine publishing industry, the lengths of web material (i.e., paper) from which individual newspapers or magazines are printed are contained on rolls (i.e., elongate members). Typically, the length of web material on a roll is fixed, and the web material is continuous from its trailing edge at the core of the roll to its leading edge at the periphery of the roll. The length of web material from an individual roll is fed into a printing apparatus where print and/or pictures are applied to the web material in a continuous, automated process. Next, the length of web material is cut into sheets of desired size and then these sheets are assembled into individual newspapers or magazines. The cutting of the sheets and the assembling of the sheets into their final print medium format is once again a continuous, automated process. Typically, during the continuous process of printing, cutting and assembling of the print medium, the length of web material travels at speeds of between 2000 and 3000 feet per minute. Hence, large numbers of individual newspapers or magazines can be produced in a relatively short period of time.

A disadvantage in the use of the rolls of web material occurs when splicing a leading edge of a "new" roll of web material to the trailing edge of an "old" roll of web material currently traveling through the continuous printing, cutting and assembling process. This type of new-to-old roll connection is referred to as a "flying splice," and is a splice made between an expiring or leading roll of web material and a new or following roll of web material in a continuous manner without reducing either the equipment speed or the speed of the web. Typically, to splice the leading edge of the new roll to the trailing edge of the old roll, one or more pieces of adhesive tape are manually applied to the leading edge of the new roll of web material. Adhesive, such as pressure sensitive adhesive, on a bottom surface of the tape secures the tape to the leading edge. With the tape secured to the leading edge of the new roll, the leading edge of the new roll is brought into contact with the old roll, where adhesive, such as pressure sensitive adhesive, on the top surface of the tape secures the leading edge of the new roll of web material to the trailing edge of the old roll of web material. Once the splicing process is complete, the movement of the web material of the old roll through the apparatus performing the printing, cutting and assembling process acts to continuously and automatically thread the web material of the new roll into the printing, cutting and assembling apparatus. Due to the complex and mostly manual nature of the process for applying a piece of flying splice adhesive tape to the leading edge of a roll of web material, the process is tedious, cumbersome and time consuming. Operator time to manually prepare and apply a flying splice to a leading edge of web material may range from about 4–10 minutes for small rolls such as may be used in magazine printing and 15–20 minutes for large rolls such as may be used in newspaper printing.

In addition, the hand work required by one or more people to manually apply a piece or pieces of flying splice adhesive tape to a length of web material is not conducive to the accurate positioning of the tape on the leading edge of the web material. Moreover, adhesive (particularly pressure sensitive adhesive) on the top and bottom surfaces of the flying splice adhesive tape tends to adhere to the leading edge of the web material virtually on contact, making repositioning of the tape difficult, and thereby further complicating the process of accurately aligning the tape on the leading edge of the web material. Misalignment of the flying splice adhesive tape on the leading edge of the web material may result in the leading edge of the new roll being incorrectly applied to the trailing edge of the old roll, which may cause the new web of material to be improperly threaded into the apparatus performing the printing, cutting and assembling process. Incorrect feeding of the new web material into the apparatus may cause the apparatus to seize thereby resulting in machine down time and lost production time. Apparatus for automatically applying flying splice adhesive tape to a leading edge of a roll of web material are generally known. Canadian Patent Application 2,069,247 to Norbert et al. discloses one such apparatus for preparing a leading edge of a new roll of web material for a flying splice. The apparatus of Norbert et al. includes a base plate for carrying a knife support block that extends substantially parallel to the axis of rotation of the roll of web material. A cutting knife of the cutting block forms the cut leading edge of the roll of web material while a perforating blade forms a perforated region in the web material spaced from the leading edge. The cutting knife and perforating blade are parallel to one another and to the axis of rotation of the web material roll. The base plate further carries an adhesive application block for holding adhesive. The adhesive application block applies a first adhesive to a lower surface of the web material between the leading edge of the web material and the web material cuts made by the perforating blade. A connecting adhesive application roller applies a second adhesive to an upper surface of the web material adjacent the web material cuts made by the perforating blade but on a side of the cuts opposite to the first adhesive. The first adhesive secures the leading edge of web material to the next underlying layer of web material on the roll of web material. The second adhesive contacts and secures the leading edge of new roll web material to a trailing edge of an expiring roll of web material and web material separation occurs along the cuts made by the perforating blade. In operation, web material is rolled off of the roll to bring the web material into position on the splice preparation apparatus of Norbert et al. The leading edge and perforations are cut and the first and second adhesives are applied to the web material. The web material is then rewound onto the roll and the leading edge of web material is secured to the next underlying layer of web material on the roll of web material via the first adhesive. Unwinding and rewinding the web material off and on the roll may cause wrinkles and misalignment of the web material due to inadvertent and misaligned adhesion of the first adhesive to the underlying layer of web material.

Co-pending U.S. patent application Ser. No. 08/112,891, filed on Aug. 27, 1993 and commonly assigned with the present application to Minnesota Mining and Manufacturing Company of St. Paul, Minn., discloses another apparatus for preparing a leading edge of a new roll of web material for a flying splice. The apparatus of U.S. patent application Ser. No. 08/112,891 includes an application frame that travels substantially parallel to the axis of rotation of the roll of web material. The application frame includes a cutting blade for forming the cut leading edge of the roll of web material. The application frame further carries a tape application device for applying a flying splice pressure sensitive adhesive tape to the leading edge of the roll of web material. The application device travels in a path parallel to the path of the cutting blade such that the flying splice adhesive tape is placed uniformly along the leading edge of the roll of web material. The application device includes an application roller to apply a length of adhesive tape along the length of the leading edge of the roll of web material. A clutch mechanism applies a constant torque to the application roller to prevent a ridge of web material from building ahead of the application roller which may cause wrinkling of the adhesive tape and web material. A buffing mechanism is also carried on the application frame. The buffing mechanism is designed to contact the adhesive tape along the length of the leading edge to ensure contact between the adhesive tape and an outer layer portion of the roll of web material that is directly adjacent the leading edge. A cut off mechanism on the application frame cuts the adhesive tape subsequent to the adhesive tape being applied to the leading edge of web material.

The flying splice adhesive tape of U.S. patent application Ser. No. 08/112,891 includes adhesive on both sides of the adhesive tape. A first adhesive secures the leading edge of the roll of web material to the next underlying layer of web material on the roll of web material. A second adhesive contacts and secures the leading edge of new roll of web material to a trailing edge of an expiring roll of web material. The flying splice adhesive tape further includes perforations along its length such that the adhesive tape separates along the perforations when the leading edge of the new roll of web material contacts the trailing edge of the expiring roll of web material.

There is a need for an improved apparatus and a method for applying flying splice adhesive tape to a leading edge of a roll of web material. Specifically, the application apparatus should permit the adhesive tape to be applied to the leading edge of the web material quickly and with alignment accuracy when compared to prior manual and automatic procedures for applying flying splice adhesive tape. The application method should prevent the creation of wrinkles in the web material as the adhesive tape is applied. In addition, the application method should not be hand work intensive, cumbersome or tedious when compared to prior manual and automatic methods for applying splice tape to the leading edge of a length of web material.

SUMMARY OF THE INVENTION

The present invention is an apparatus for applying a length of adhesive tape from a supply of adhesive tape along the length of a leading edge of a roll of web material. The application apparatus includes a main frame configured to be positioned adjacent the leading edge of the roll of web material. A transportation frame assembly is mounted on the main frame and is configured to be positioned adjacent the leading edge of web material. The transport frame assembly includes a supply mechanism for holding a supply of adhesive tape. A tape applicator on the transport frame is configured to remove the adhesive tape from the supply of adhesive tape and apply a length of the tape along a length of the leading edge of the roll of web material.

A take-up mechanism removes a liner from the adhesive tape prior to the application of the adhesive tape along the length of the leading edge of web material. The transport frame further includes a web cutting mechanism for cutting the length of web material to form the leading edge of the roll of web material. The web cutting mechanism operates to form the length of leading edge as the transport frame moves along the length of the roll of web material.

The application mechanism further includes a buffing mechanism that is designed to contact the adhesive tape applied along the leading edge of the roll of web material to ensure contact between the adhesive tape and an outer layer portion of the roll of web material that is directly adjacent to the leading edge. The buffing mechanism is designed to operate after the tape 52 has been applied along the entire length of the roll of web material. The buffing mechanism is designed to contact the adhesive tape uniformly and simultaneously along the entire width of the roll of web material. A tape cut off mechanism cuts the adhesive tape to form the length of adhesive tape along the leading edge of the roll of web material subsequent to the adhesive tape being applied to the leading edge, and prior to the buffing mechanism contacting the adhesive tape.

This application apparatus allows flying splice adhesive tape to be applied to the leading edge of the roll of web material quickly while ensuring alignment accuracy. The use of a non-contact application mechanism ensures that the leading edge of web material beneath the tape is wrinkle free. In addition, due to the automated nature of the application apparatus, the hand work normally required to apply flying splice adhesive tape to the leading edge of a roll of web material can be virtually eliminated, thus resulting in a reduction of time required to apply the splice tape to the roll of web material.

These drawing figures are provided for illustrative purposes only and are not drawn to scale, nor should they be construed to limit the intended scope and purpose of the present invention.

DETAILED DESCRIPTION OF THE PREFERRED EMBODIMENTS

Figure 1:
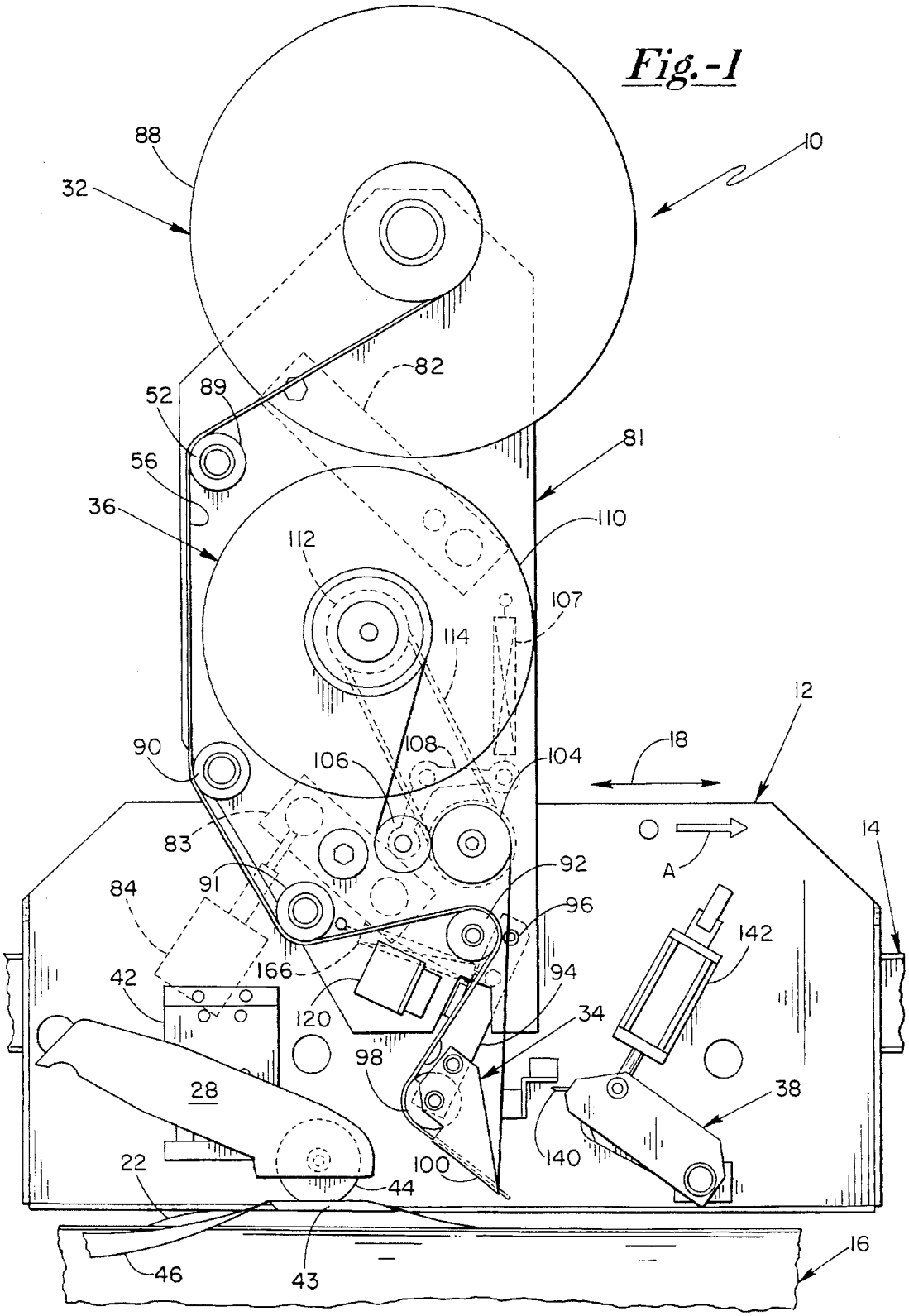
FIG. 1 is a front elevational view of an application apparatus in accordance with the present invention with a cutting mechanism shown forming a length of leading edge on a roll a length of web material.
Figure 1A:
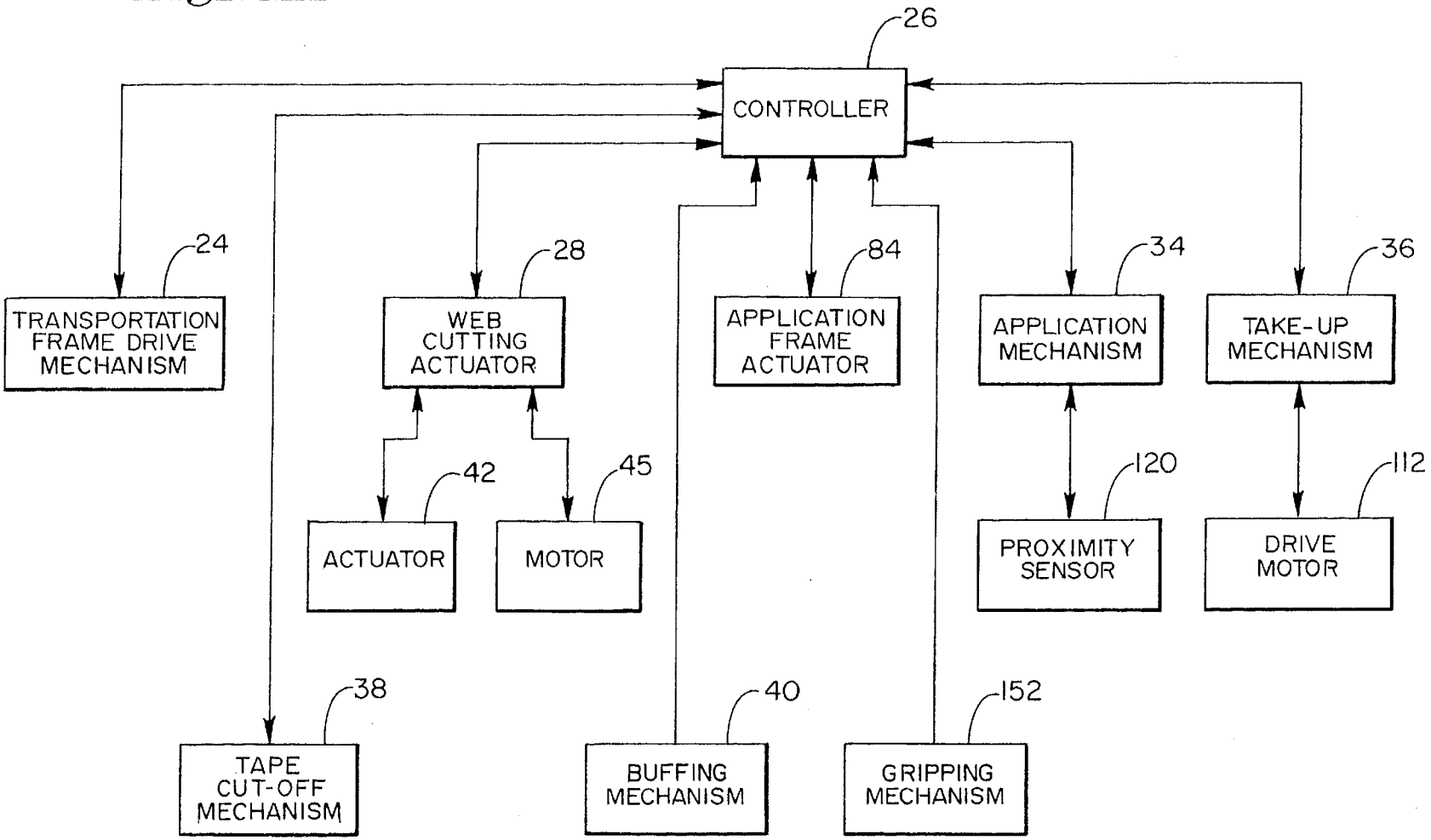
FIG. 1A is a block diagram of the control system of the present invention.
Figure 2:
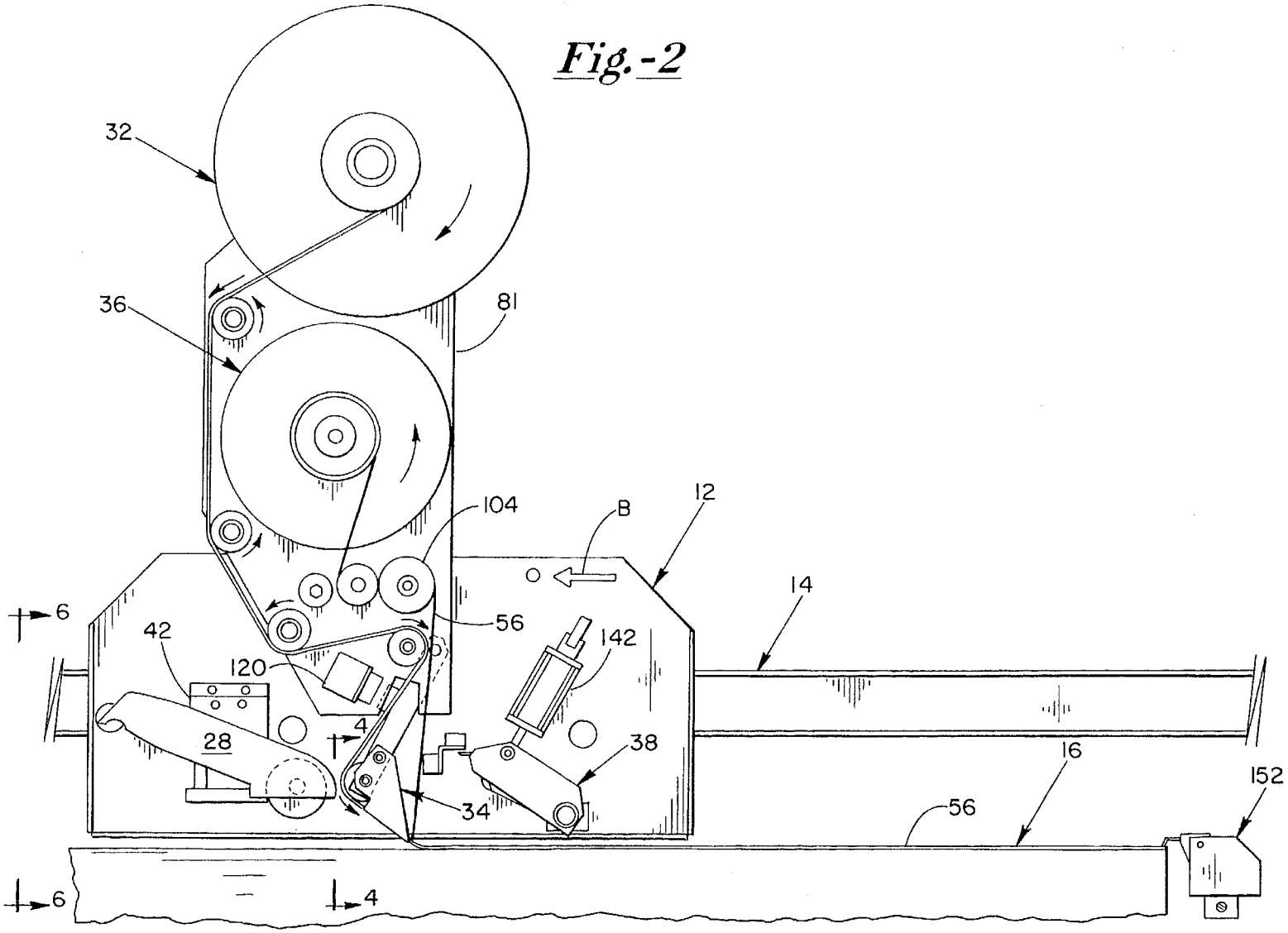
FIG. 2 is a front elevational view similar to FIG. 1 illustrating the operation of an application mechanism.
Figure 5:
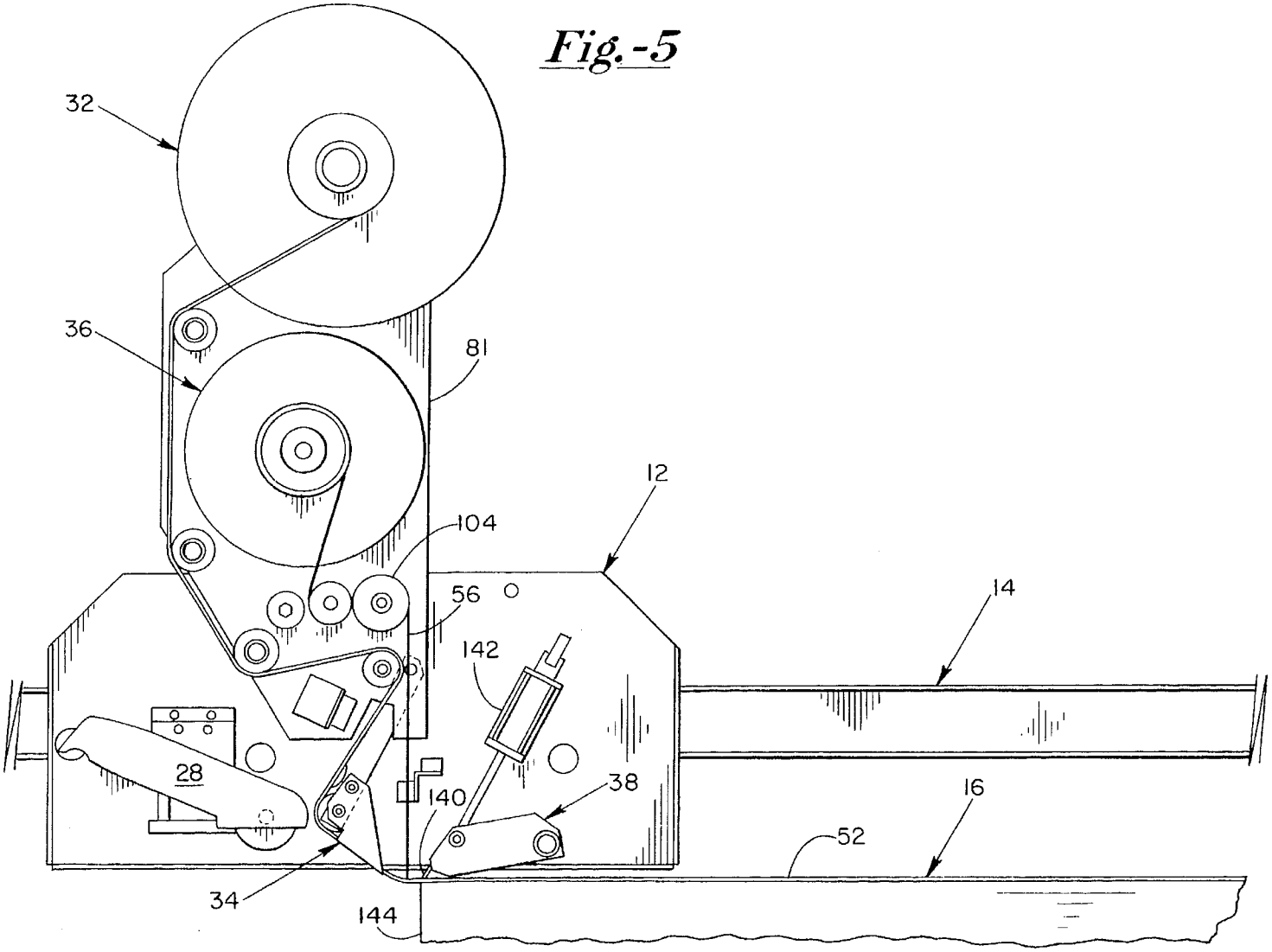
FIG. 5 is a side elevational view similar to FIG. 2 illustrating the operation of a cut off mechanism.

An application apparatus 10 in accordance with the present invention is illustrated generally in FIGS. 1, 2 and 5. It should be noted that while the present invention is described in terms of the application of adhesive tape to the leading edge of a roll of web material, the present invention is easily adaptable by those skilled in the art to apply a strip of material to nearly any substantially flat surface. The apparatus 10 includes a transport frame 12 relative to a main frame 14. As seen in FIGS. 1 and 2, the application apparatus 10 is configured such that the transport frame 12 can be disposed adjacent a roll of web material 16. The application frame 12 is linearly moveable relative to the main frame 14 in opposite directions (as represented by double-headed arrow 18 in FIG. 1) parallel to a leading edge 22 of the web material 16. A drive mechanism 24 (FIG. 1A) is configured to drive the transport frame 12 in a first linear direction "A" (see FI6. 1) and in a second, opposite linear direction "B" (see FIG. 2) along the roll of web material 16. The drive mechanism 24 is preferably mechanical, but may alternatively be hydraulic or pneumatic in nature. The drive mechanism 24 is controlled by a controller 26, such as a microprocessor, to precisely control the speed and direction of the transport frame 12.

Figure 6:
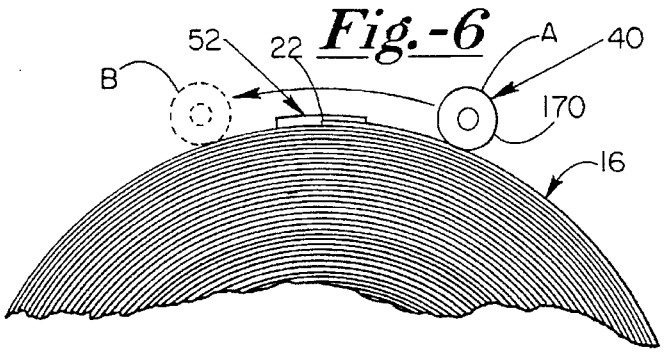
FIG. 6 is a side elevational view taken along lines 6—6 in FIG. 2 illustrating the operation of a buffing mechanism.

As will be described more clearly below, the application apparatus 10 operates in four steps: a leading edge preparation step (FIG. 1), the tape application step (FIGS. 2–4), a tape cut off step (FIG. 5), and a tape buffing step (FIG. 6). A number of mechanisms are mounted on the transport frame 12 to perform these steps. The leading edge preparation step is performed by a web cutting mechanism 28. The tape application step is performed by a supply mechanism 32, an application mechanism 34 and a take-up mechanism 36. The tape cut off step is performed by a tape cut off mechanism 38. The buffing step is performed by a buffing mechanism 40 (FIG. 6). The various mechanisms operate at varying times during the operation of the application apparatus 10. Accordingly, the controller 26 is connected to these various mechanisms to effectuate the operation of the mechanisms. In addition, one or more drive mechanisms (e.g., motors) are operably connected to the controller 26 to provide power to a variety of the mechanisms. A block diagram depicting the various mechanisms controlled by the controller 26 is seen in FIG. 1A.

FIG. 1 illustrates the application apparatus 10 during the leading edge preparation step. The step precisely forms the leading edge 22 on the roll of web material 16 as the transport frame 12 is moved in direction "A" from a first end of the web material 16 to a second end. The cutting mechanism 28 is used to form the leading edge 22 on the roll of web material 16 and is the only mechanism on the transport frame 12 that is operating during the leading edge preparation step. The cutting mechanism 28 is commercially available under the name Chickadee II Rotary Shear, Type D2, manufactured by Eastman Machine Company of Buffalo, N.Y. The cutting mechanism 28 is linearly moveable relative to the transport frame 12 by a linear actuator 42. The linear actuator 42 is controlled by the controller 26 and functions to move the cutting mechanism 28 to an operative position as shown in FIG. 1 for cutting the web material 16. The cutting mechanism 28 includes a cutting guide 43 and a circular cutting blade 44. The circular cutting blade 44 is driven by a motor 45 in the web cutting mechanism 28 which is controlled by the controller 26. The circular cutting blade 44 rotates at a speed sufficient to cut the web material 16 to form the leading edge 22. The cutting guide 43 is disposed adjacent the cutting blade 44 and is configured to lift and support a rough edge portion 46 of the web material 16. The cutting guide 43 holds the rough edge portion 46 of the web material 16 away from the roll of web material 16 when the transport frame 12 travels in linear direction "A". The cutting guide 43 thereby acts to create contact between the rotating cutting blade 44 and the web material 16 to form the leading edge 22. Once the transport frame 12 has traveled the full length of the roll of web material 16, the leading edge 22 is fully formed, the cut-away rough edge portion 46 is discarded, the motor of the cutting mechanism 28 is shut down by the controller 26, and the linear actuator 42 moves the cutting mechanism 28 to a non-operative position.

Figure 3:
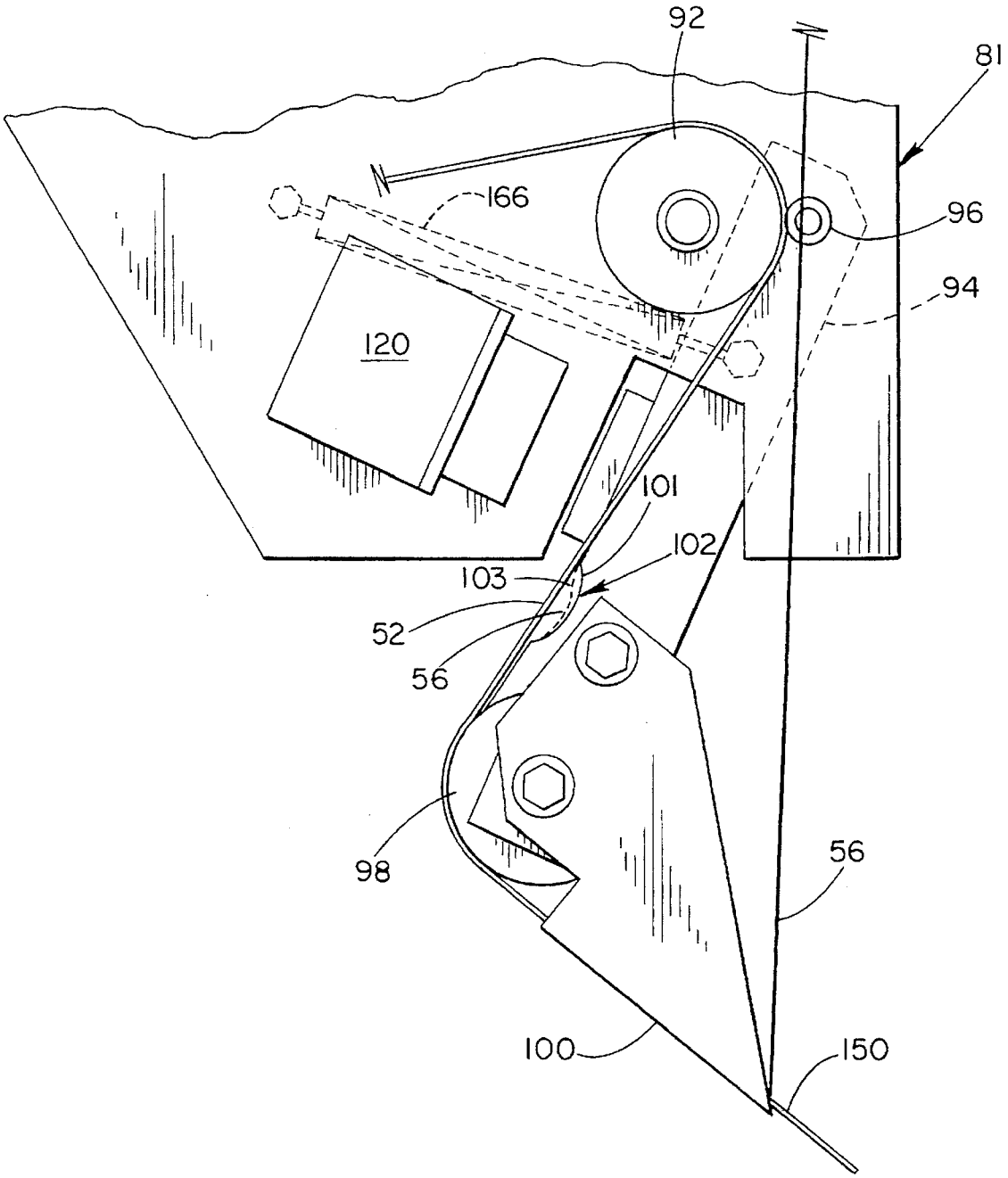
FIG. 3 is an enlarged view of the application mechanism shown in FIGS. 1 and 2.
Figure 4:
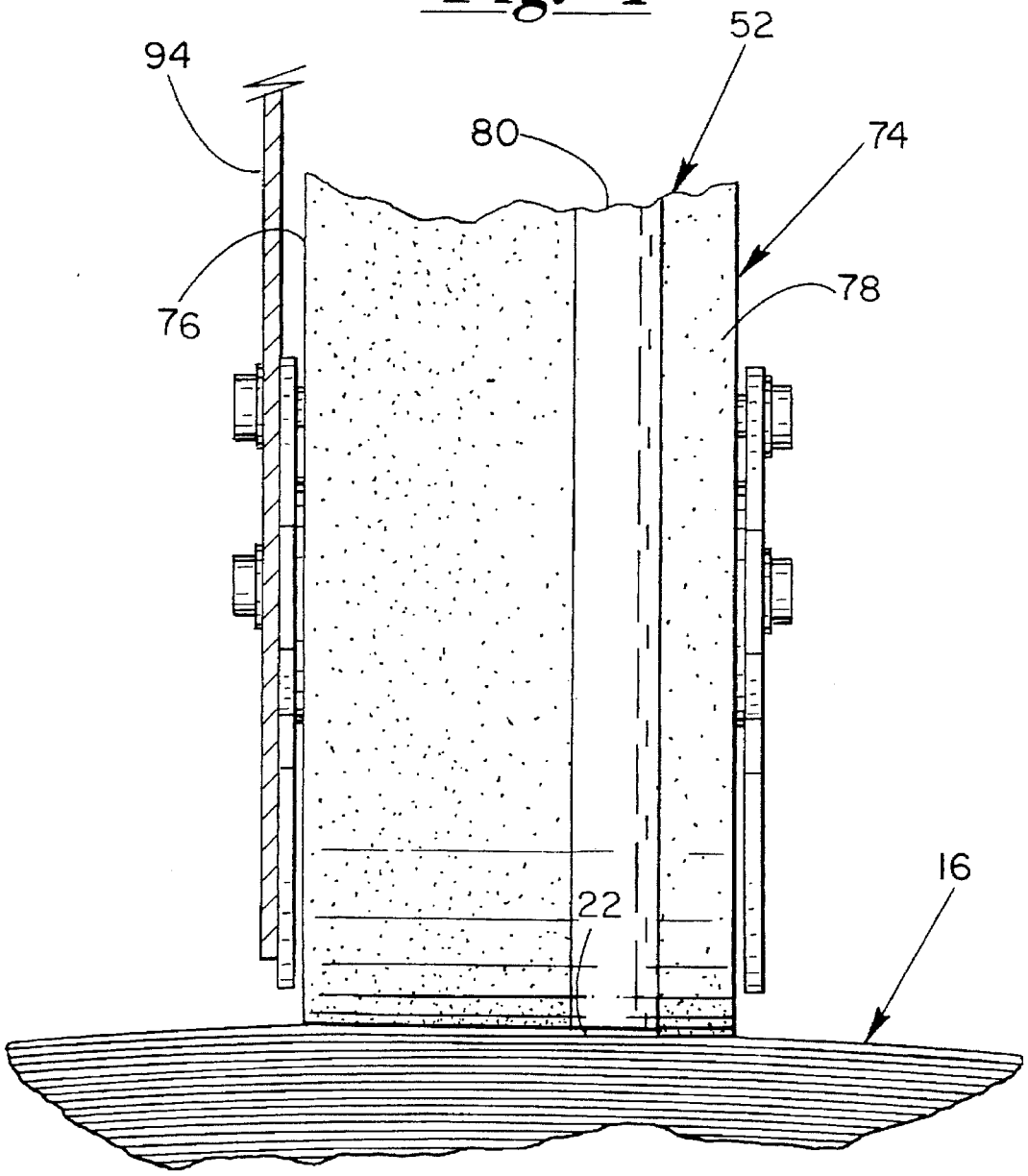
FIG. 4 is a sectional view taken along line 4—4 in FIG. 2.
Figure 7:
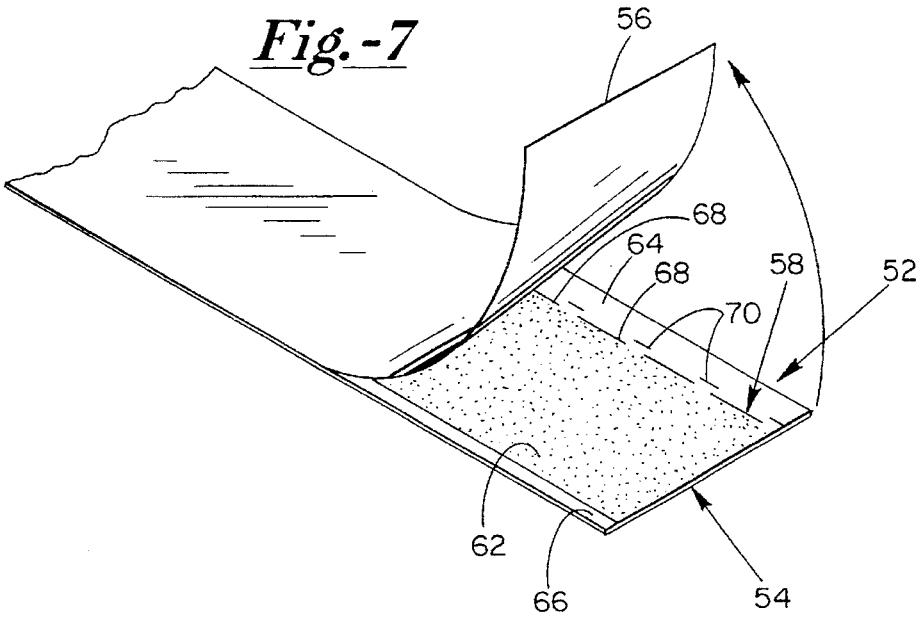
FIG. 7 is a perspective view of a top surface of flying-splice adhesive tape usable with the application apparatus in accordance with the present invention.
Figure 8:
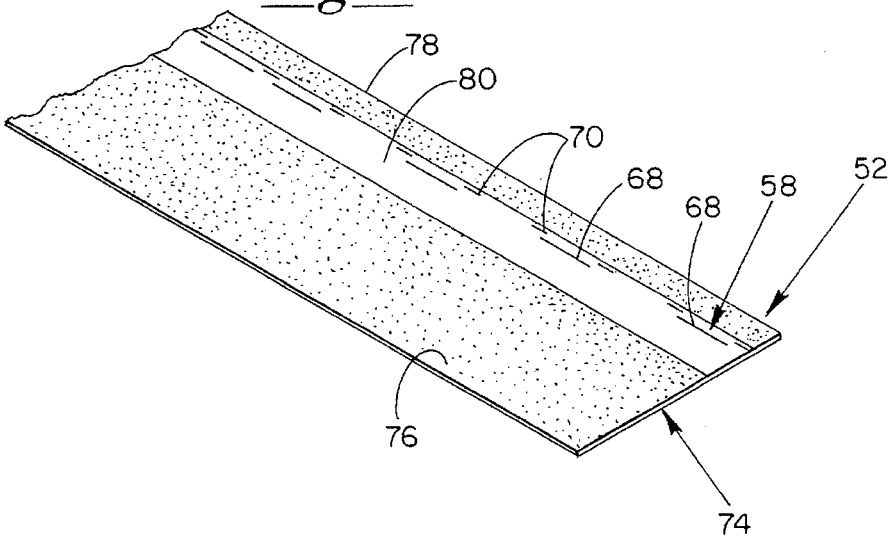
FIG. 8 is a perspective view of a bottom surface of the flying-splice adhesive tape show in FIG. 7.

The application apparatus 10 performs the tape application step after the leading edge preparation step is completed. FIGS. 2–4 show the application apparatus 10 during the tape application step (which takes place as the application frame is moved in direction "B" from the second end of the roll of web material 16 back to the first end). However, a short description of the tape that is applied by the application apparatus 10 will provide a better understanding of the various functions performed by the application apparatus 10 during the tape application step. Accordingly, FIGS. 7 and 8 more clearly show the nature of a pressure sensitive flying splice adhesive tape 52 that is used in conjunction with the application apparatus 10. The tape 52 has adhesive on both sides. FIG. 7 shows a top surface 54 of the pressure sensitive flying splice adhesive tape 52. A liner 56 is adhered to the top surface 54 so that the tape 52 and the liner 56 can be placed in rolled configuration as shown in FIGS. 1, 2 and 5. A perforation pattern 58 extends throughout the length of the tape 52. On the top surface 54 of the tape 52, the perforation pattern 58 separates a trailing edge tackified portion 62 from a trailing edged untackified or detackified portion 64. An end margin untackified or detackified portion 66 runs along an outer edge of the tackified portion 62. The perforation pattern 58 defines a controlled tape separation line for the new to old roll flying-splice connection. As shown in FIGS. 7 and 8, a preferred perforation pattern is a series of offset long and short linear cuts 68 and 70, respectively, through the tape 52.

FIG. 8 shows a bottom surface 74 of the tape 52. The bottom surface 74 has a leading edge tackified portion 76, an outer layer tackified portion 78, and a leading edge untackified or detackified portion 80 bearing the perforation pattern 58 therein. A complete description of the tape 52 can be found in U.S. patent application Ser. No. 08/113,413, entitled FLYING SPLICE ADHESIVE TAPE, filed on Aug. 27, 1993 and commonly assigned with the present application to Minnesota Mining and Manufacturing Company of St. Paul. U.S. patent application Ser. No. 08/113,413 is incorporated herein by reference thereto. It is to be understood that other flying splice adhesive tapes are useable with the application apparatus 10 of the present invention.

FIG. 4 more clearly shows the preferred application of the bottom surface 74 of the tape 52 upon the roll of web material 16. As seen in FIG. 4, the leading edge 22 of the web material 16 is preferably disposed within the leading edge untackified or detackified portion 80 of the tape 52 immediately adjacent the leading edge tackified portion 76. As will be discussed below, the application apparatus 10 is configured to apply the tape 52 in this preferred position.

After the web cutting mechanism 28 has prepared the leading edge 22 of the roll of web material 16, the application apparatus 10 applies the adhesive tape 52 to the web material 16. The following describes the mechanisms used to apply the pressure sensitive, flying spice adhesive tape 52 to the roll of web material 16, as well as the mechanisms used to remove the liner 56 from the tape 52. As seen in FIGS. 1, 2 and 5, an application frame 81 is mounted to the transport frame 12 by a first linkage bar 82, a second linkage bar 83, and an actuator 84. The actuator 84 moves the application frame 81 between an operative and non-operative position. The supply mechanism 32, application mechanism 34, and take-up mechanism 36 are each mounted to the application frame 81. The linkage bars 82, 83 are of lengths such that when the actuator 84 places the application frame 81 in an operative position, the tape 52 is presented to the leading edge 22 of the roll of web material 16.

The supply mechanism 32 is essentially a spool 88 holding tape 52 and liner 56 rotatably mounted on the application frame 81. A friction brake (not shown) is disposed on the spool 88 to ensure that the tape 52 and the liner 56 remain taut as they extend around a first idler roller 89, a second idler roller 90, a third idler roller 91, and a fourth idler roller 92 and then to the application mechanism 34.

As seen in FIG. 2, the application mechanism 34 places the tape 52 upon the roll of web material 16 as the application frame 12 moves in the second linear direction "B". As best seen in FIG. 3, the application mechanism 34 includes a dancer arm 94 which is pivotally mounted to the application frame 81 at a pivot 96. As the adhesive tape 52 and liner 56 enter the application mechanism 34, the tape 52 and liner 56 extend around a fifth idler roller 98 and then pass over a peeler plate 100. As the tape 52 and liner 56 pass over the peeler plate 100, the liner 56 is pulled at a sharp angle relative to the tape 52 and is thereby separated from the tape 52. The tape 52 continues in a path substantially parallel to the plate of the peeler plate 100, while the liner 56 travels to the take-up mechanism 36.

As the tape 52 and liner 56 pass around idler rollers 89, 90, 91, 92 and 98, the tape 52 and liner 56 occasionally become delaminated. The delamination typically occurs because the tape 52 and liner 56 experience slightly different path lengths as the tape 52 and liner 56 pass around a bend in their path. For example, as the tape 52 and liner 56 pass around idler roller 98, the liner 56 experiences a slightly shorter path length then the tape 52 because the liner 56 is located on the inside of the turn. As a result of the slightly shorter path length, the liner 56 will tend to delaminate from the tape 52. A delamination area typically is found immediately before the tape 52 and liner 56 pass over the idler roller 98. As the tape 52 and liner 56 continue to pass over the roller 98, the area of delamination grows, and often a ridge 101 of delaminated liner 56 will appear immediately before the roller 98, as seen in FIG. 3. Occasionally, a portion of the liner 56 does not delaminate from the tape 52, and the ridge 101 of delaminated liner 56 is pulled between the tape 52 and the roller 98. If it is large enough, the ridge 101 creates wrinkles in the tape 52 and can cause misplacement of the tape 52 on the roll of web material 16. However, small "buckles" of delaminated liner 56 usually do not interfere with the application of the tape 52. To combat the creation of large "buckles" in the liner 56 which may interfere with application of the tape 52, a delamination device 102 is incorporated into the dancer arm 94 immediately before idler roller 98. The relamination device 102 comprises a surface 103 which functions to prevent a large ridge 101 of delaminated liner 56 from developing by directing the delaminated liner 52 back toward the adhesive tape 52. Specifically, the shape of the surface 103 directs the liner 56 back toward the tape 52. As the liner 56 is directed toward the tape 52, a relamination force is generated by the movement of the liner 56 into the tape 52. In this manner, small areas of delamination are forced past the roller 98 and thereby prevented from growing. In addition, the surface 103 is spaced from the tape 52 and liner 56 by such a distance that there is not enough room for a delamination ridge 101 to grow to a size sufficient to interfere with the application of the tape 52. Once the liner 56 fully contacts the surface 103, there is no additional room for the ridge 101 to grow.

The take-up mechanism 36 works in conjunction with the application mechanism 34 to remove the liner 56 from the tape 52. The take-up mechanism 36 includes a drive roller 104, an idler nip roller 106, and a spool 110 rotatably mounted on the application frame 81. A drive motor 112 (controlled by the controller 26) drives the drive roller 104 and the take-up spool 110. The drive roller 104 is driven by the drive motor 112 via a belt 114, and the spool 110 is driven through a friction clutch (not shown) to keep the liner 56 taut as it is wound about the spool 110. The action of the drive roller 104 pulling the liner 56 serves to remove the tape 52 and liner 56 from the supply mechanism 32. A spring 107 maintains pressure between the nip roller 106 and the drive roller 104 via a lever arm 108 (FIG. 1).

The drive motor 112 is controlled by the controller 26 in response to signals from a position sensor 120 positioned adjacent the dancer arm 94 (best seen in FIG. 3). As described below, the position of the dancer arm 94 changes as the transport frame 12 moves in direction "B" across the roll of web material 16, with the position of the dancer arm 94 related to the speed of the transport frame 12. The position sensor 120 senses the location of the dancer arm 94 and signals the controller 26. Using information from the position sensor 120, the controller 26 determines the speed of the drive motor 112 (and thus the drive roller 104) to remove the tape 52 and the liner 56 from the supply mechanism 32 at a rate equal to the speed of the transport frame 12. It is understood that the position sensor 120 may comprise any conventional proximity switch or electrical sensing device which relates the position of the dancer arm 94 and thus the demanded tape tension to the controller 26 for controlling the speed of drive motor 112 and thus the tape tension. Preferably, the position sensor 120 is a force sensing device that changes its electrical resistance in response to a force applied to it and which converts such changes in resistance to a control signal that indicates the position of the dancer arm 94 to the controller 26.

Figure 9:
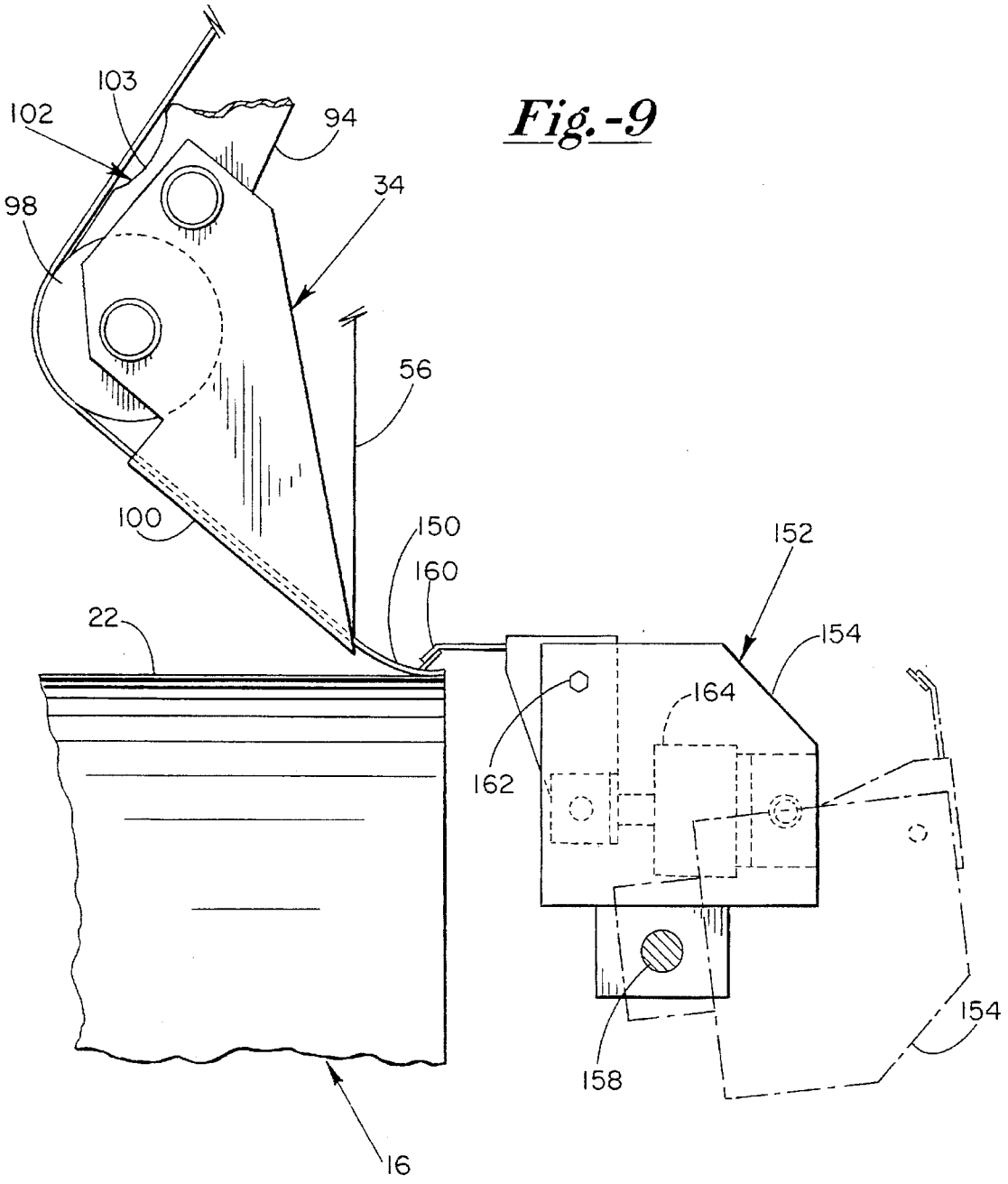
FIG. 9 is an enlarged view of the application mechanism and gripping assembly as shown in FIG. 2.

At the beginning of the tape application step, a tab 150 of adhesive tape 52 extends from the peeler plate 100, as best seen in FIGS. 3 and 9. The tab 150 of the adhesive tape 52 is presented to the leading edge 22 of the roll of web material 16 by actuation of linear actuator 84 which places application frame 81 in an operative position. The tab 150 is then held firmly to the roll of web material 16 by a gripping apparatus 152. The gripping apparatus 152 includes a gripping head 154 which is pivotally mounted to a frame (not shown). The frame is adapted to move the gripping apparatus 152 to a "parked" position out of the work area when the gripping apparatus 152 is not in use. The gripping head 154 is coupled to the frame at a pivot 158. The gripping head 154 is rotated about the pivot 158 by a rotary actuator (not shown). The gripping head 154 further includes a gripping edge 160. The gripping edge 160 is pivotally mounted to the gripping head 154 about a pivot 162. A linear actuator 164 rotates the gripping edge 160 about the pivot 162 to cause the gripping edge 160 to firmly hold the tab 150 of adhesive tape 52 to the leading edge 22 of the roll of web material 16.

After the tab 150 of the adhesive tape is secured to the web material 16 by the gripping edge 160, the transport frame 12 is moved in second direction "B" by the drive mechanism 24. As the transport frame 12 moves in the second direction "B", the dancer arm 94 begins to pivot about the pivot 96 in a counter-clockwise direction. As the dancer arm 94 begins to rotate about the pivot 96, the position sensor 120 signals the location of the dancer arm 94 to the controller 26. The controller 26 then actuates the drive motor 112 to pull the liner 56 and adhesive tape 52 from the supply spool 88. As the drive motor 112 begins to pull the liner 56 and adhesive tape 52 from the supply spool 88, a spring 166 begins to rotate the dancer arm 94 back in a clockwise direction. Thus, in response to signals from the position sensor 120, the controller 26 continues to regulate the speed of the drive motor 112 to remove adhesive tape 52 and liner 56 at a speed substantially matching the linear movement of the transport frame 12 along the roll of web material 16.

As best seen in FIG. 3, the tape 52 and liner 56 pass close to the pivot 96 for the dancer arm 94. By passing the tape 52 and the liner 56 near the pivot 96, the rotational forces generated by the tape 52 and the liner 56 which would cause the application mechanism 34 to rotate about the pivot 96 are reduced to small magnitudes when compared to the force generated by the spring 166. The tension in the adhesive tape 52 after it is separated from the liner 56 may thus be considered solely a function of the tension in the spring 166. The tension in the tape 52 may thus be regulated by adjusting the tension of spring 166.

Applying the tape 52 to the roll of web material 16 in the manner described above provides advantages over prior art tape application devices. The tension in the tape 52 is easily controlled via the spring 166, thereby allowing the application apparatus 10 to be adjusted to accommodate different types of tape 52 and web material 16. In addition, no portion of the application device 34 contacts the web material 16 during application of the tape 52. The gripping apparatus 152 prevents the tape 52 from pulling on the web material 16 such that no wrinkles are formed in the web material 16, and the tape 52 contacts the web material 16 only after the liner 56 has been removed and the tension in the tape 52 has been determined by spring 166. In this manner, wrinkles in the web material 16 are prevented from forming. Finally, the movement of the buffing roller 170 circumferentially about the roll of web material 16 functions to prevent the creation of wrinkles in the web material 16 and further functions to tighten the outer layer portion of the roll of web material 16.

After the tape 52 has been applied to the leading edge 22 of the roll of web material 16, the tape 52 is cut. FIG. 5 illustrates the tape cut off mechanism 38 in its tape cutting position. The tape cut off mechanism 38 includes a cutting blade 140 that is connected to a linear actuator mechanism 142. The linear actuator mechanism 142 is controlled by the controller 26 to selectively activate the tape cut off mechanism 38. The cutting blade 140 is normally in a non-operative position spaced from the tape 52, as seen in FIGS. 1 and 2. To severe the tape 52, when the application mechanism is adjacent an outer end edge 144 of the roll of web material 16, the linear actuator 142 is activated to move the cutting blade 140 into an operative position shown in FIG. 5. The application frame 81 is moved to its non-operative position. The transport frame 12 is then again moved in the second direction "B", causing the application mechanism 34 on the dancer arm 94 to rotate in a counter clockwise direction. The tension placed on the tape 52 by the movement of the transport frame 12 causes the tape 52 to move against the cutting blade 140, thereby severing the tape 52. Only the tape 52 is cut by the cutting blade 140. The liner 56 is not cut. After the tape 52 is cut, the transport frame 12 continues to move in direction "B" to a position clear of the roll of web material 16.

The arced shape of the roll of web material 16 and the flat shape of the peeler plate 100 may impair the outer tackified portion 78 of the tape 52 from properly adhering to the outer layer portion of the roll of web material 16 directly adjacent leading edge 22 of the roll of web material 16. Therefore, as shown in FIG. 6, the buffing mechanism 40 is provided to ensure contact between the outer layer tackified portion 78 and the outer layer portion adjacent the leading edge 22. The buffing mechanism 40 includes a buffing roller 170 which extends the length of the roll of web material 16 and is freely rotatably mounted to a support element (not shown). The support element is operated by the controller 26 to move the buffing roller 170 curve linearly about the circumference of the roll of web material 16 from a non-operative position A to an operative position B (shown in phantom). The path of the buffing roller 170 thus matches the contours of the roll of web material 16. As the buffing roller 170 is moved circumferentially about the roll of web material 16 from the non-operative position A to the operative position B, the buffing roller 170 contacts the entire width of the trailing edge untackified or detackified portion 64 of the tape 52 to ensure proper contact between the outer layer tackified portion 78 of the tape 52 and the outer layer portion of the roll of web material 16. The movement of the buffing roller 170 from non-operative position A to operative position B is desirable to ensure a wrinkle-free leading edge 22. The circumferential path of the buffing roller 170 allows the buffing roller 170 to contact the tape 52 uniformly and simultaneously across the width of the roll of web material 16, thereby reducing the occurrence of wrinkles in the web material 16. Preferably, the then circumferential movement of the buffing roller 170 is oriented to tighten the outer layer of web material 16 as the buffing roller moves from non-operative position A to operative position B.

The inventive application apparatus 10 disclosed herein provides an automated means for applying pressure sensitive flying splice adhesive tape 52 to the roll of web material 16. The application apparatus 10 provides a means for forming the precise leading edge 22 upon the roll of web material 16, as well as means for applying the tape 52 upon the roll of web material 16 such that the tape 52 is automatically properly aligned with the leading edge 22. The use of the application mechanism 34 ensures that leading edge 22 of the web material 16 beneath the tape 52 is wrinkle free. In addition, the application apparatus 10 provides a means for removing the liner 56 from the adhesive tape 52 prior to the application of the tape. 52 along the leading edge 22. Furthermore, the tape cut off mechanism 38 automatically cuts the tape 52 after it has been applied to the leading edge 22 and the buffing mechanism 42 ensures that the tape 52 is positively adhered to the outer layer portion of the roll of web material 16 along its entire length.

Figure 10:
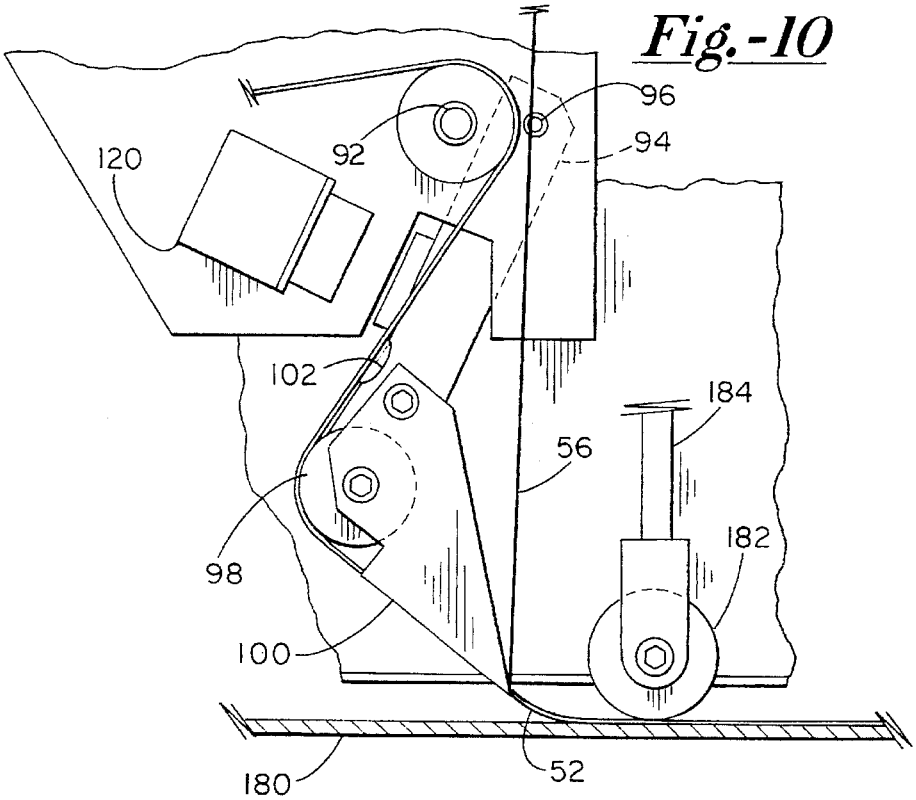
FIG. 10 is an enlarged view of the application mechanism and an application roller used in place of the gripping assembly of FIG. 9.
Figure 11:
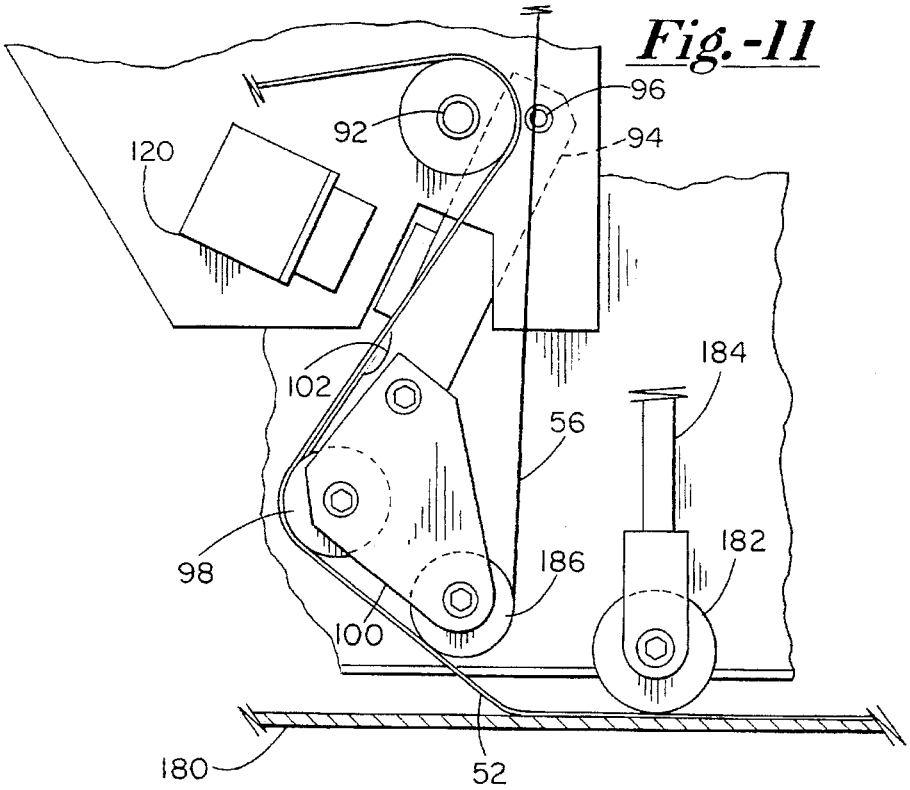
FIG. 11 is an enlarged view of an alternative application mechanism used with the application roller of FIG. 10.

The application apparatus of the present invention may be easily adapted by those skilled in the art to apply a strip of material to nearly any substantally flat surface. Alternative embodiments of the present invention are shown in FIGS. 10 and 11. As seen in FIGS. 10 and 11, a strip of adhesive tape 52 is being applied to a surface 180. An application roller 182 is shown clamping the tape 52 to the surface 180. The application roller 182 replaces the gripping assembly 152 (FIGS. 2 and 9) and functions to clamp the tape 52 to the surface 180 as the transportation frame 12 moves across the surface 180. The application roller 182 is mounted to the transportation frame 12 via a support assembly 184 and linear actuator (not shown). The application roller 182 is movable between an application position (seen in FIGS. 10 and 11) in which the application roller contacts the tape 52, and a non-operative position in which the application roller 182 is spaced from the tape 52. When a tab 150 of the tape 52 (FIG. 3) is presented to the surface 180, the application roller is moved to its application position. The application roller thereby clamps the tab 150 of tape 52 to the surface 180. As the transportation frame 12 moves across the surface 180, the dancer arm 94 rotates about the pivot 96 and the tape 52 is pulled from the supply of adhesive tape in a manner identical to that describe above. As the tape 52 is applied to the surface 180, the application roller rolls over the tape 52, thereby also functioning to ensure contact between the tape 52 and the surface 180.

FIG. 11 shows an alternative configuration of the application mechanism 34. The peeler plate 100 of the application mechanism 34 may be replaced with a peeler roller 186. The peeler roller 186 functions to separate the tape 52 from the liner 56. The tape 52 is then applied to the surface 180 in the manner describe above.

Finally, while the figures depict the application mechanism being transported across the surface to which the tape is being applied, only relative movement between the application mechanism and the surface is required. Thus, the application apparatus of the present invention may be adapted such that the surface to which tape is applied is moved past the application mechanism, (e.g., on a conveyer system) while the application mechanism remains stationary.

Although the present invention has been described with reference to preferred embodiments, workers skilled in the art will recognize that changes may be made in form and detail without departing from the spirit and scope of the invention.

What is claimed is:

1. An apparatus for applying a length of adhesive tape from a supply of adhesive tape along the length of a leading edge of a roll of web material, the apparatus comprising;

a main frame;

a transportation frame assembly mounted on the main frame and configured to be positioned adjacent a leading edge of a roll of web material, the transportation frame assembly including:

a supply mechanism for holding a supply of adhesive tape;

a tape applicator for applying a length of adhesive tape along a length of the leading edge of the roll of web material, the tape applicator positioned in spaced relation from the roll of web material during application of the tape along the length of the leading edge;

a gripping assembly fixedly positioned adjacent a first end of the main frame for securing a free end of the length of adhesive tape to the leading edge of the roll of web material during the application of the length of adhesive tape along the leading edge of the roll of web material;

a buffing mechanism positioned adjacent the roll of web material and extending the entire length of the leading edge of the roll of web material, the buffing mechanism circumferentally moveable between a buffing position wherein the buffing mechanism uniformly and simultaneously contacts the entire length of the adhesive tape, and a non-operative position wherein the buffing mechanism is spaced from the adhesive tape; and a cutting mechanism for cutting the length of adhesive tape from said supply of adhesive tape.

2. The application apparatus of claim 1, further including:

a drive mechanism for moving the transportation frame assembly relative to the main frame in a first linear direction along a length of the roll of web material and in a second linear direction opposite to the first direction back along the length of the roll of web material.

3. The application apparatus of claim 2, wherein the transportation frame further includes:

a cutting mechanism for cutting the length of web material to form a length of leading edge on the roll of web material, the cutting mechanism acting to form the length of leading edge as the drive mechanism moves the transportation frame assembly in the first linear direction along the length of web material.

4. The application apparatus of claim 3, wherein the cutting mechanism includes:

a circular cutting blade rotating at a speed sufficient to cut the length of web material to form the length of leading edge on the roll of web material.

5. The application apparatus of claim 4, wherein the cutting mechanism further includes:

a cutting guide adjacent the cutting blade, the cutting guide being configured to lift a portion of the length of web material to effect contact between the rotating cutting blade and the continuous length of web material as the transportation frame assembly travels in the first linear direction along the length of the roll of web material.

6. The application apparatus of claim 2, wherein the supply of adhesive tape is a supply of adhesive tape adhered to a liner and wherein the apparatus further includes:

a take-up mechanism for removing the liner from the adhesive tape prior to the application of the adhesive tape along the length of the leading edge of the roll of web material.

7. The application apparatus of claim 6, wherein the tape applicator includes:

an application frame mounted to the transportation frame and moveable between an application position, wherein adhesive tape adhered to a liner is removed from the supply of adhesive tape and wherein a length of adhesive tape that is free from a liner is applied along the length of the leading edge of the roll of web material, and a non-operative position wherein no removal of adhesive tape or application of adhesive tape occurs.

8. The application apparatus of claim 7, wherein the application frame includes:

an application mechanism mounted on the application frame, the application mechanism coupled to the drive motor such that as the transportation frame travels in the second linear direction along the length of the leading edge of the roll of web material the drive motor removes adhesive tape adhered to a liner from the supply of adhesive tape; and a peeler plate mounted on the application mechanism such that in the application position of the application frame the peeler plate is in spaced relation from the leading edge of the roll of web material, and as the transportation frame assembly travels in the second linear direction along the length of the leading edge of the roll of web material the peeler plate applies a length of adhesive tape that is free from a liner along the length of the leading edge of the roll of web material.

9. The application apparatus of claim 8, wherein the application mechanism includes a dancer arm pivotally mounted between the application frame and the peeler plate, the peeler plate mounted on the dancer arm, the dancer arm cooperating with a dancer arm position sensor to regulate the tape speed.

10. The application apparatus of claim 9, wherein the position sensor comprises a force sensing device that changes its electrical resistance in response to force applied to it and which converts such change in resistance to a control voltage that is indicative of the position of the dancer arm and corresponding tape speed, and which is provided to a controller for the drive motor.

11. The application apparatus of claim 9, wherein the position sensor comprises a proximity sensor.

12. The application apparatus of claim 1, wherein the buffing mechanism includes:

a support mechanism configured to permit curvilinear movement between the buffing position and the non-operative position, the curvilinear path of the support element matching the circumference of the roll of web material; and a buffing roller rotatably mounted on the support mechanism, the buffing roller extending the entire length of the leading edge of the roll of web material and capable of simultaneously contacting the surface of the outer layer portion of the roll of web material along the entire length of adhesive tape.

13. The application apparatus of claim 12, wherein the buffing roller of the buffing mechanism tightens the outer layer portion of the roll of web material as the buffing roller moves from the non-operative position to the buffing position.

14. The application apparatus of claim 2, wherein the transportation frame assembly further includes:

a cut off mechanism for cutting the adhesive tape subsequent to the adhesive tape being applied to the leading edge of the roll of web material to form the length of adhesive tape along the leading edge of the web material.

15. The application apparatus of claim 14, wherein the cut off mechanism includes:

a cut off blade moveable between a cut off position wherein the cut off blade cuts the adhesive tape to form the length of adhesive tape and a non-operative position wherein the cut off blade is spaced from the adhesive tape and no cutting occurs; and an actuator for moving the cut off blade between the cut off position and the non-operative position.

16. The application apparatus of claim 6, wherein the take-up mechanism includes:

a take-up member for holding the liner removed from the adhesive tape adhered to the liner;

a drive wheel for pulling the adhesive tape adhered to the liner from the supply of adhesive tape and removing the liner from the adhesive tape prior to the application of the adhesive tape along the length of the leading edge of the roll of web material; and a drive motor coupled to the drive wheel and take-up member for driving the drive wheel and take-up member.

17. An apparatus for applying a length of adhesive tape from a supply of adhesive tape onto a surface, the apparatus comprising:

a main frame;

a supply mechanism supported by the main frame for holding a supply of adhesive tape;

an application mechanism supported by the main frame for removing adhesive tape from the supply of adhesive tape and for applying a length of adhesive tape on a surface, the tape applicator positioned in spaced relation from the surface during application of the tape along the length of the surface;

a clamping mechanism for securing the free end of the length of adhesive tape to the surface during the application of the length of adhesive tape to the surface; and a transportation assembly for causing relative linear motion between the application mechanism and the surface; and a cutting mechanism for cutting the length of adhesive tape from said supply of adhesive tape.

18. The application apparatus of claim 17, wherein the supply of adhesive tape is a supply of adhesive tape adhered to a liner, and wherein the application mechanism includes:

a peeling apparatus for removing the liner from the adhesive tape, and wherein the peeling apparatus is mounted to a dancer arm and positioned such that as the transportation assembly travels across the surface the peeler apparatus applies a length of adhesive tape that is free from a liner along the surface.

19. The application apparatus of claim 18, wherein the peeling apparatus comprises a peeler plate.

20. The application apparatus of claim 18, wherein the peeling apparatus comprises a peeler roller.

21. The application apparatus of claim 18, wherein the application mechanism includes a dancer arm cooperating with a dancer arm position sensor to regulate the speed of the adhesive tape via a drive motor removing the tape from the supply of adhesive tape.

22. The application apparatus of claim 21, wherein the position sensor comprises a force sensing device that changes its electrical resistance in response to force applied to it and which converts such change in resistance to a control voltage that is indicative of the position of the dancer arm and a corresponding tape speed, the control voltage provided to a controller for controlling the drive motor.

23. The application apparatus of claim 21, wherein the position sensor comprises a proximity sensor.

24. The application apparatus of claim 17, wherein the clamping mechanism comprises:

an application roller moveable between an application position, wherein the application roller contacts the adhesive tape applied to the surface to clamp the adhesive tape to the surface, and a non-operative position wherein the application roller is spaced from the adhesive tape applied to the surface.

25. The application apparatus of claim 24, wherein the application roller is mounted to the transportation frame and is in its application position as the peeling apparatus applies a length of adhesive tape along the surface.

26. The application apparatus of claim 17, wherein the clamping mechanism is fixedly positioned adjacent a first end of the surface.

* * * * *